United States Patent [19]

Sommers

[11] 4,005,972

[45] Feb. 1, 1977

[54] INVERTIBLE APPARATUS FOR MOLDING A CONCRETE PANEL

[75] Inventor: Alex Sommers, North Miami Beach, Fla.

[73] Assignee: Bearingwall Systems Inc., Hollywood, Fla.

[22] Filed: Apr. 4, 1975

[21] Appl. No.: 565,101

[52] U.S. Cl. ..... 425/439; 249/137; 425/443; 425/452

[51] Int. Cl.[2] ..... B28B 13/05

[58] Field of Search ..... 425/432, 439, 443, 449, 425/454, 456; 249/137, 138, 136, 74, 142, 156, 177, 124; 222/238, 252; 141/387, 284, 67

[56] References Cited

UNITED STATES PATENTS

| | | | |
|---|---|---|---|
| 847,618 | 3/1907 | Steinhoff | 249/124 |
| 978,600 | 12/1910 | Lampman | 249/124 |
| 1,154,387 | 9/1915 | Dolen | 425/439 |
| 1,242,120 | 10/1917 | Andrews | 425/449 |
| 2,298,446 | 10/1942 | White | 249/124 |
| 2,407,168 | 9/1946 | Lindkuist | 425/456 |
| 3,021,867 | 2/1962 | Gallagher | 141/387 |
| 3,149,392 | 9/1964 | Ripley | 425/439 |
| 3,196,513 | 7/1965 | Parma | 425/439 |
| 3,659,986 | 5/1972 | Gelbman | 425/449 |
| 3,682,448 | 8/1972 | Kedzior et al. | 259/165 |
| 3,704,979 | 12/1972 | Thiessen | 425/454 |
| 3,753,453 | 8/1973 | Madden et al. | 141/387 |

FOREIGN PATENTS OR APPLICATIONS

| | | | |
|---|---|---|---|
| 908,887 | 4/1946 | France | 425/439 |

*Primary Examiner*—Robert L. Spicer, Jr.
*Assistant Examiner*—John McQuade
*Attorney, Agent, or Firm*—Oltman and Flynn

[57] ABSTRACT

Apparatus for molding a concrete panel having:

a. an articulated concrete-pouring mechanism with pivotally inter-connected horizontal tubes, each containing a motor-driven feed screw;

b. a mold frame pivoted on a vertically-fixed, horizontal axis to be turned from an upright position, which it occupies while being filled with wet concrete, to an inverted position;

c. a bottom plate and core assembly in the mold frame mounted for limited, vertically guided movement downward in the mold frame when it is turned over;

d. and a vertically-displaceable platform below the mold frame for receiving the concrete filling from the mold cavity when the concrete is stripped from the mold due to its own weight and the weight of the bottom plate and core moving down in the inverted mold frame.

3 Claims, 18 Drawing Figures

C
S
70
78
73
74
75
71
72
80
82
83
79
81
84
85
50
51
52
40
42
100
101
102
54a
54b
54c
20
21
22
23
25a
25b
26
29
31
32
33

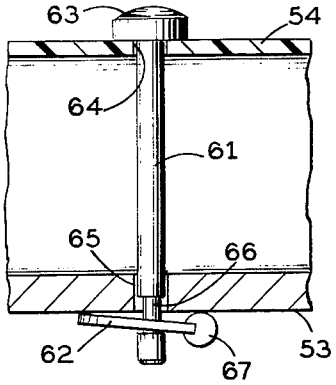
FIG. 6
FIG. 5
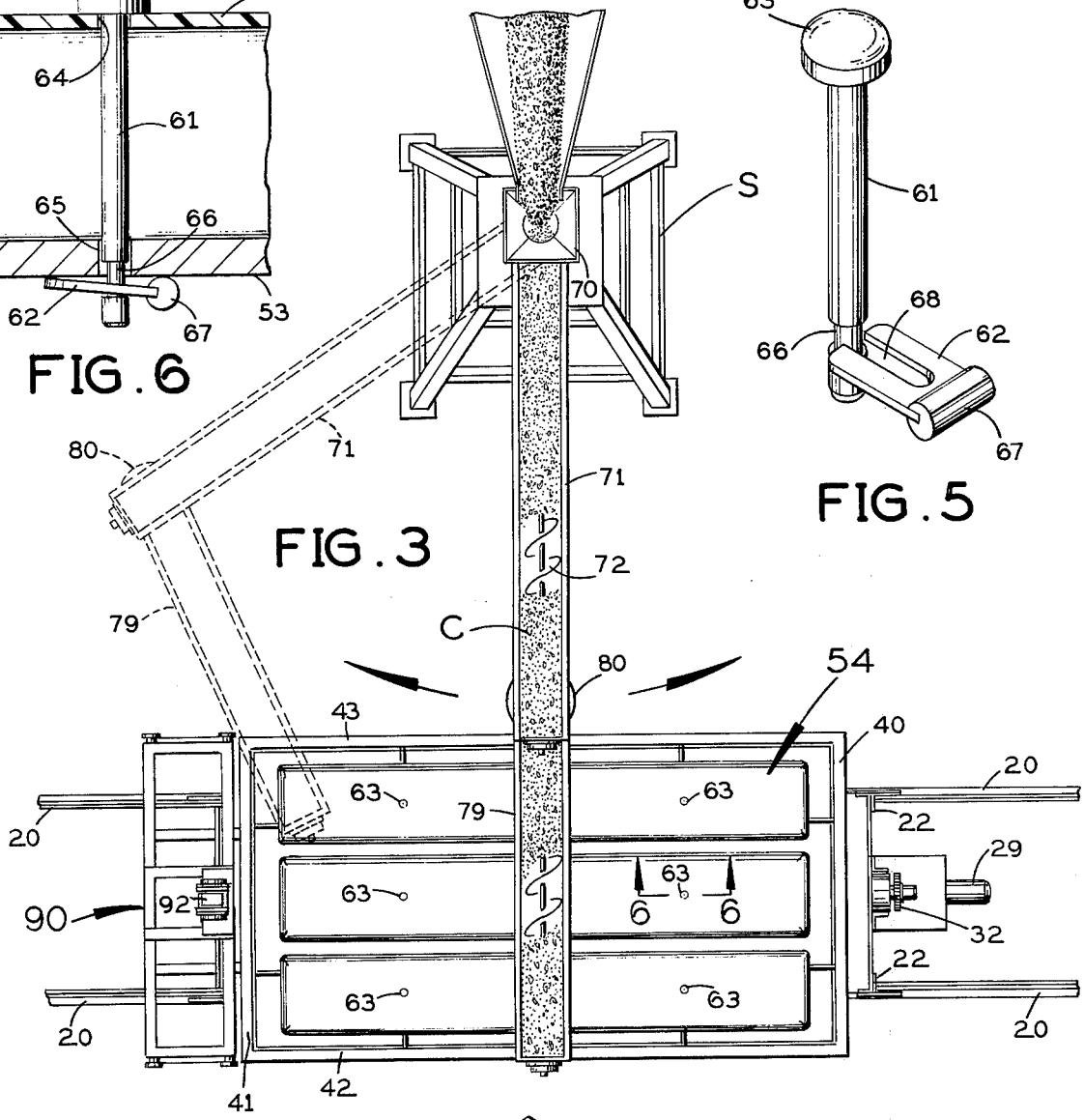
FIG. 3
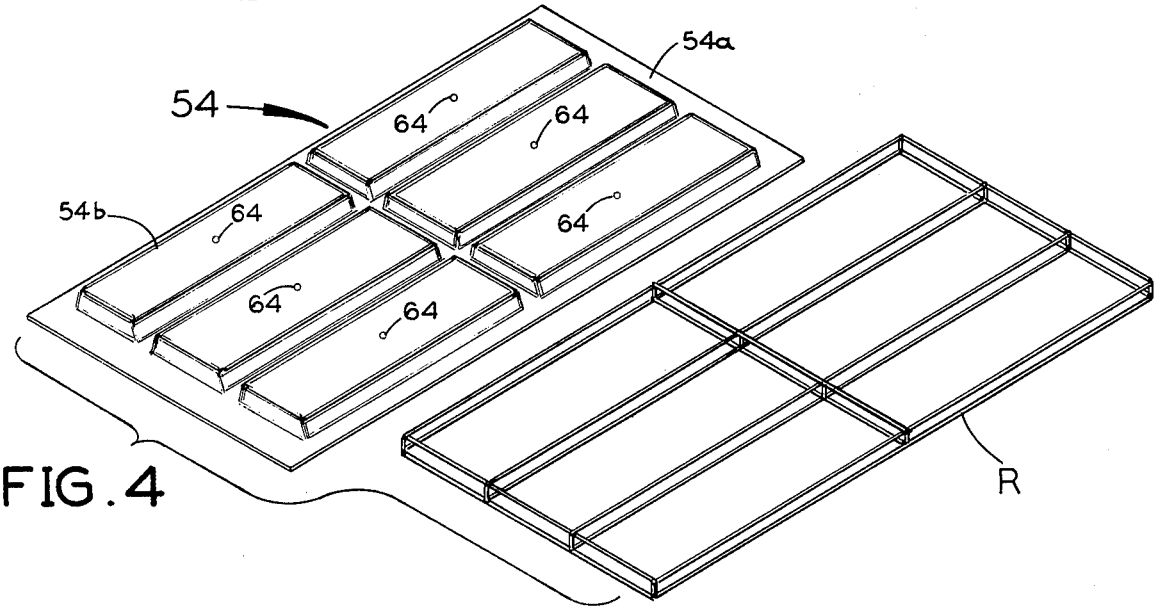
FIG. 4

FIG. 15
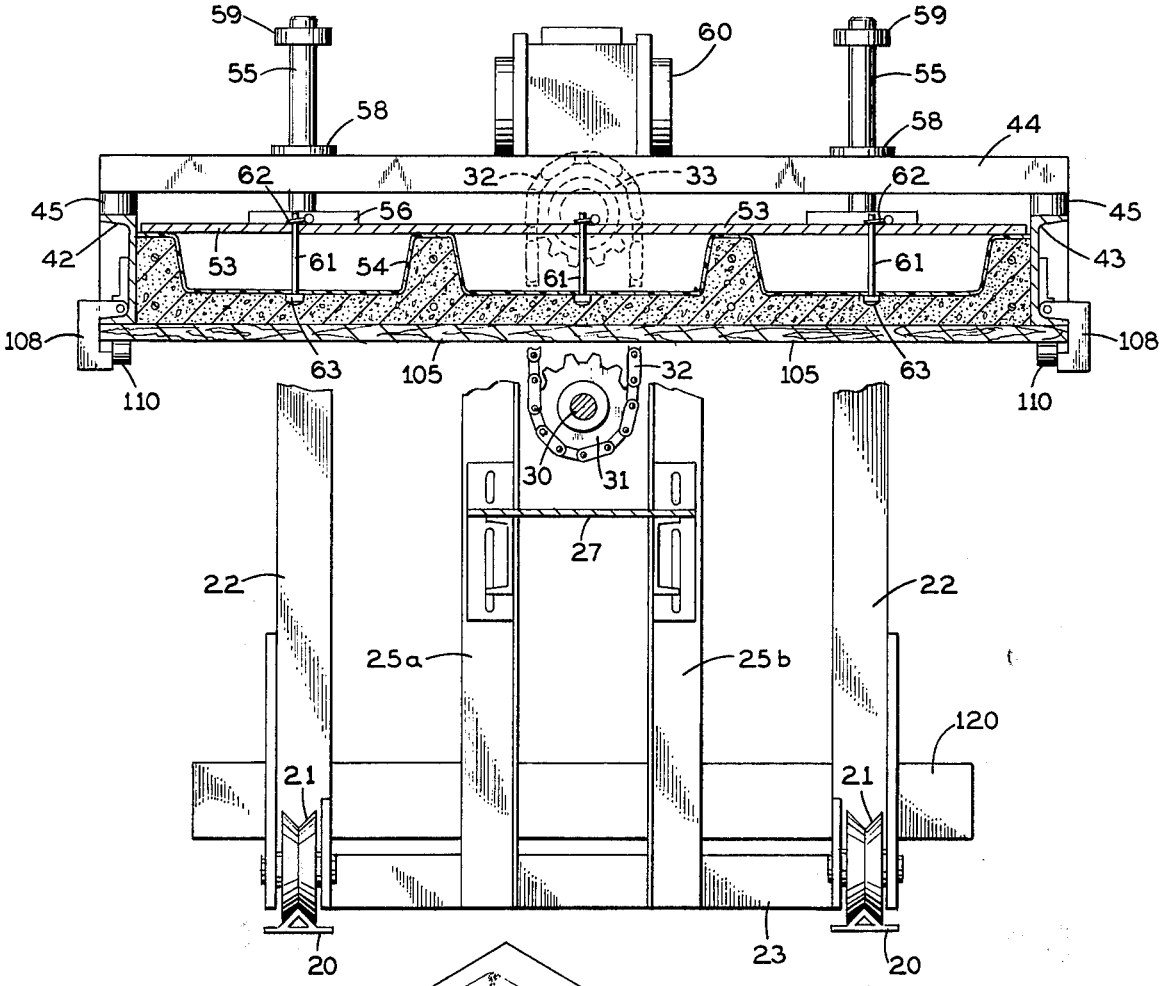
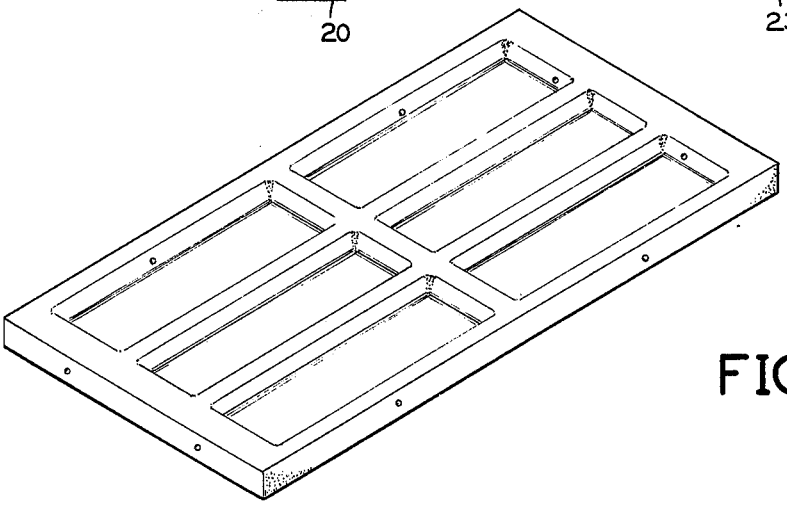
FIG. 18

INVERTIBLE APPARATUS FOR MOLDING A CONCRETE PANEL

BACKGROUND OF THE INVENTION

Various arrangements have been proposed heretofore for molding panels and other bodies. One such arrangement is disclosed in U.S. Pat. No. 3,659,986 to Gelbman. Others are shown in the following U.S. patents: U.S. Pat. No. 1,574,565, Ferguson; U.S. Pat. No. 2,298,446, White; U.S. Pat. No. 2,394,228, Barber; U.S. Pat. No. 2,466,339, Turner; U.S. Pat. No. 3,154,831, Pehoski; U.S. Pat. No. 3,193,874, Jablonski; U.S. Pat. No. 3,528,144, Haponski; U.S. Pat. No. 3,679,340, Springs; U.S. Pat. No. 3,704,979, Thiessen; U.S. Pat. No. 3,732,052, Gunia; U.S. Pat. No. 3,751,201, Kelsey; and U.S. Pat. No. 3,824,059, Heltzel.

None of these prior arrangements is entirely satisfactory for producing structural building panels of concrete. For example, the problem of achieving the homogeneity of the concrete in the finished panel that is essential to meet present-day strength requirements was not adequately solved by the previous machines. In addition, many of the prior machines did not provide entirely satisfactory solutions to the problem of stripping the concrete filling cleanly from the mold.

SUMMARY OF THE INVENTION

The present invention is directed to a novel and improved apparatus for forming a concrete panel which satisfactorily solves the practical problems involved. In accordance with the present invention the desired homogeneity is achieved with the help of a novel pouring mechanism, which is easily adjustable over the complete area of the mold, and a novel arrangement for imparting vibrations to the concrete filling in the mold. The clean stripping of the concrete filling from the mold is achieved by means of an advantageous arrangement for supporting and pivotally inverting the mold, a vertically displaceable platform below the mold for receiving the concrete filling from the inverted mold, and a novel arrangement of parts in the mold which moves down to assist in stripping the concrete filling from the inverted mold as the platform is lowered.

Other capabilities and advantages of this invention will be apparent from the following detailed description of a presently-preferred embodiment, shown in the accompanying drawings in which:

FIG. 3 is a top plan view of this apparatus, with a phantom-line showing of the concrete pouring mechanism at one extremity of the mold cavity.

FIG. 4 is a perspective view of the mold core;

FIG. 5 is an exploded perspective view of one of the pin devices for releasably clamping the core to the bottom plate of the mold assembly;

FIG. 6 is a fragmentary vertical section taken along the line 6—6 in FIG. 3 and showing the FIG. 5 clamping device in place;

FIG. 15 is a view generally similar to FIG. 12, but showing the mold inverted and the pallet clamped below it to hold the wet concrete in the mold;

FIG. 18 is a perspective view of a concrete panel produced by the present molding apparatus.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figures 1, 13, 14:
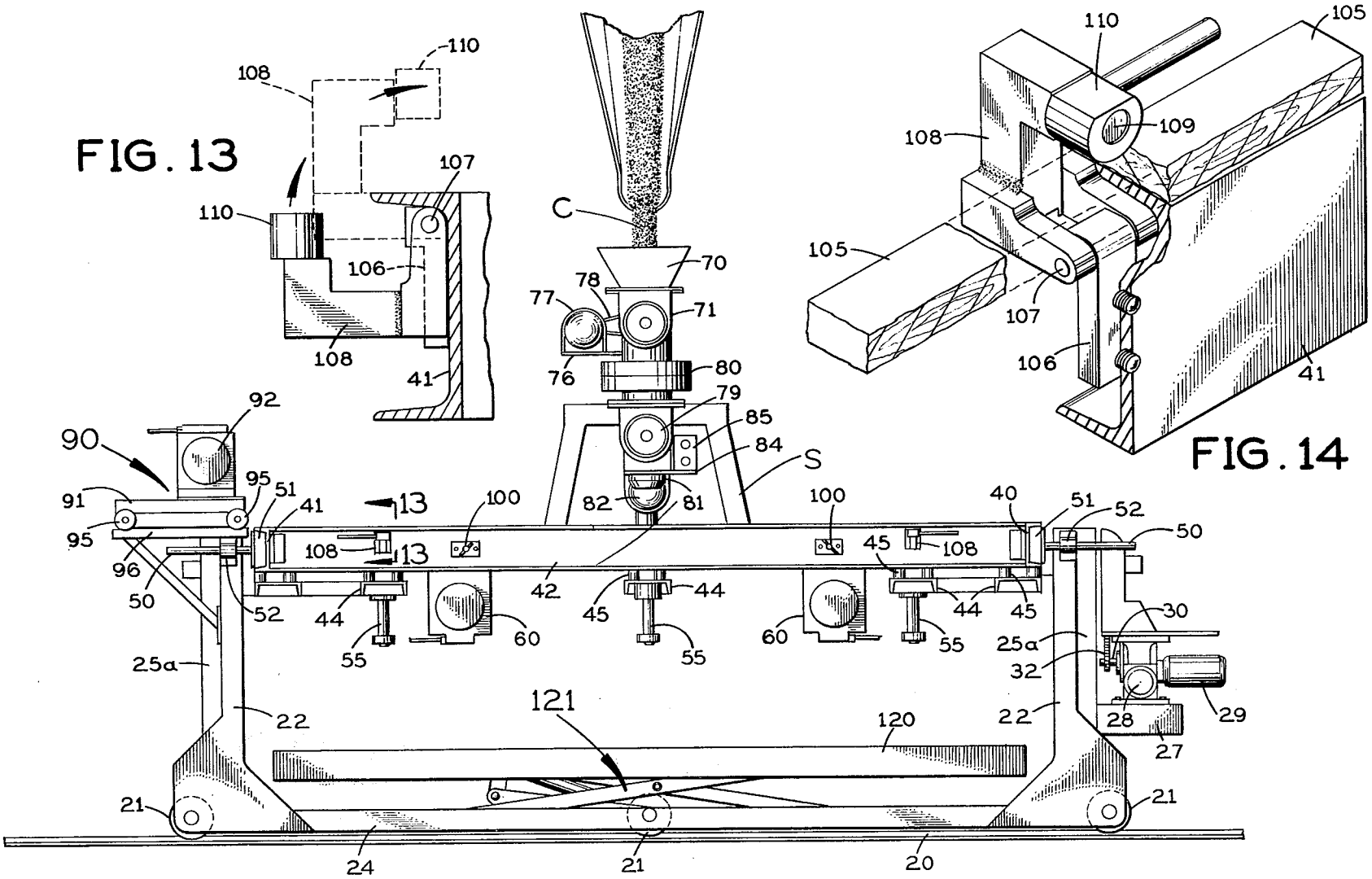
FIG. 1 is a front elevational view of the present apparatus while the mold is in its upright position for receiving wet concrete.
FIG. 13 is a fragmentary vertical section taken along the line 13—13 in FIG. 1 and showing one of the pivoted clamps for holding the pallet on the top of the mold, with this clamp shown retracted in full lines and in its clamping position in phantom.
FIG. 14 is a fragmentary perspective view, with parts broken away for clarity, showing the FIG. 13 clamp holding the pallet in place.
Figures 2, 10, 11:
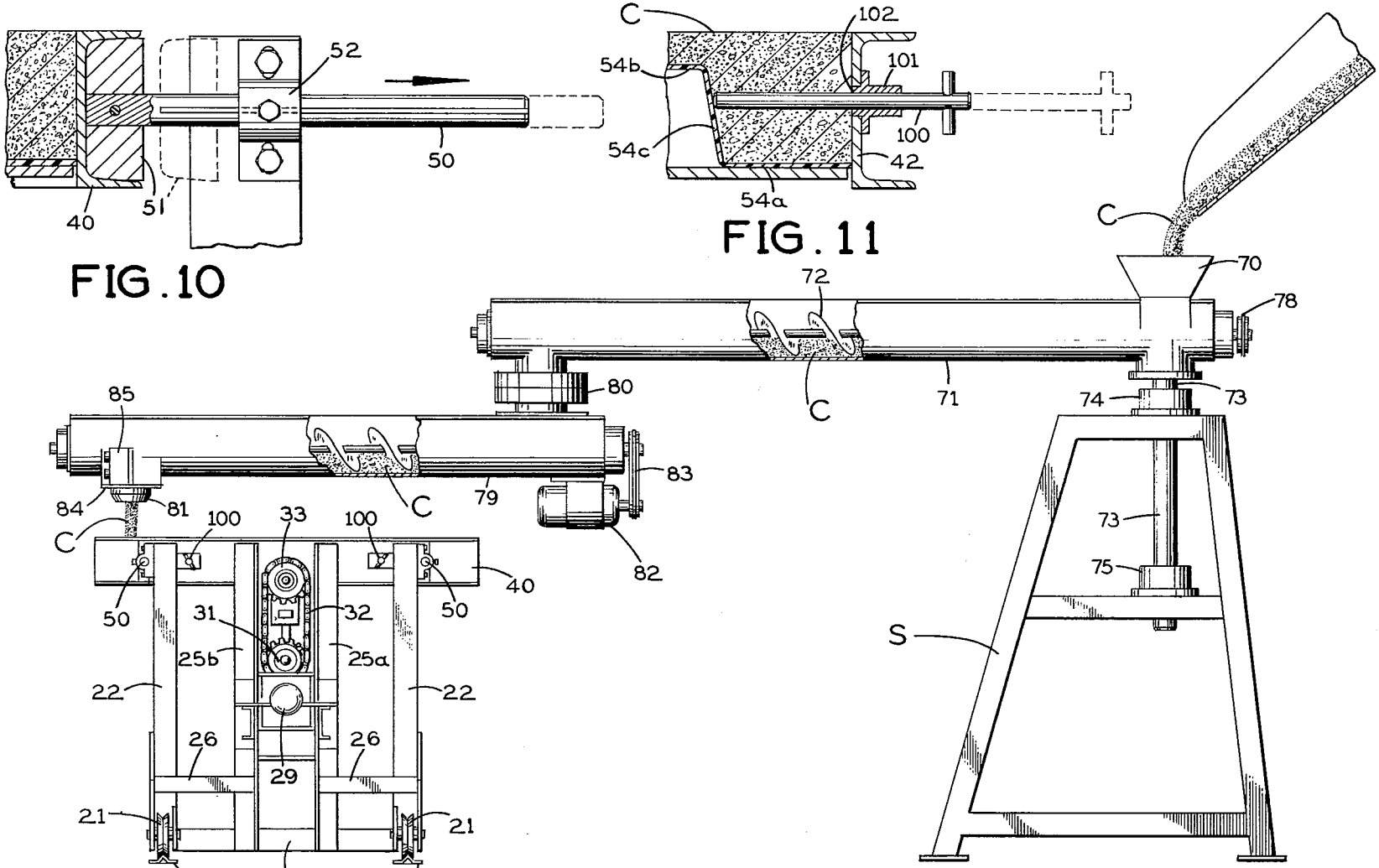
FIG. 2 is an end elevation of this apparatus, showing in detail the novel mechanism for pouring wet concrete into the mold.
FIG. 10 is a fragmentary vertical section taken along the line 10—10 in FIG. 8 and showing one of the stabilizing members for holding the mold upright.
FIG. 11 is a fragmentary vertical section taken along the line 11—11 in FIG. 8 and showing one of the horizontal core pins at the mold.

Referring first to FIGS. 1 and 2, the apparatus of the present invention is shown mounted on floor-supported, horizontal rails 20, one spaced behind the other as shown in FIG. 2. Each rail presents a respective upwardly-facing, inverted V, which extends lengthwise of the rail and is engaged by V-grooved rollers 21 at each end of the apparatus. These rollers are on the lower ends of respective upstanding corner posts 22, which form part of the rigid framework of the apparatus. At each end the front and back corner posts 22 are connected to a respective bottom cross piece 23 (FIG. 2). The two corner posts 22 at the front are interconnected by a rigid longitudinal bottom piece 24 of the framework (FIG. 1), and this is also true of the two corner posts at the back.

At each end the rigid framework has a pair of vertical uprights 25*a* and 25*b* (FIG. 2) extending up from the respective bottom cross piece 23 and one spaced behind the other in FIG. 1. A horizontal piece 26 connects each of these vertical members to the nearest corner post 22 at a suitable distance above the bottom crosspiece 23 to enhance the framework's rigidity.

A horizontal platform 27 is attached to the uprights at the right end of the apparatus in FIG. 1. A gear reduction 28 driven by an electric motor 29 is mounted on this platform. The output shaft 30 of the gear reduction carries a sprocket 31 (FIG. 12) which drives the lower end of an endless chain 32. At its upper end this chain drives a sprocket 33 mounted on a horizontal pivot shaft 34. An anti-friction bearing 35 (FIG. 7), rigidly supported by the uprights 25*a* and 25*b*, rotatably supports the pivot shaft 34 at this end of the support framework.

At the opposite end of the apparatus, a similar horizontal pivot shaft 36 is rotatably supported by an anti-friction bearing 37, which is rigidly supported by the uprights 25*a* and 25*b* at that end. The two pivot shafts at the opposite ends of the apparatus have a conjoint horizontal axis of rotation which has a fixed vertical position.

Figure 8:
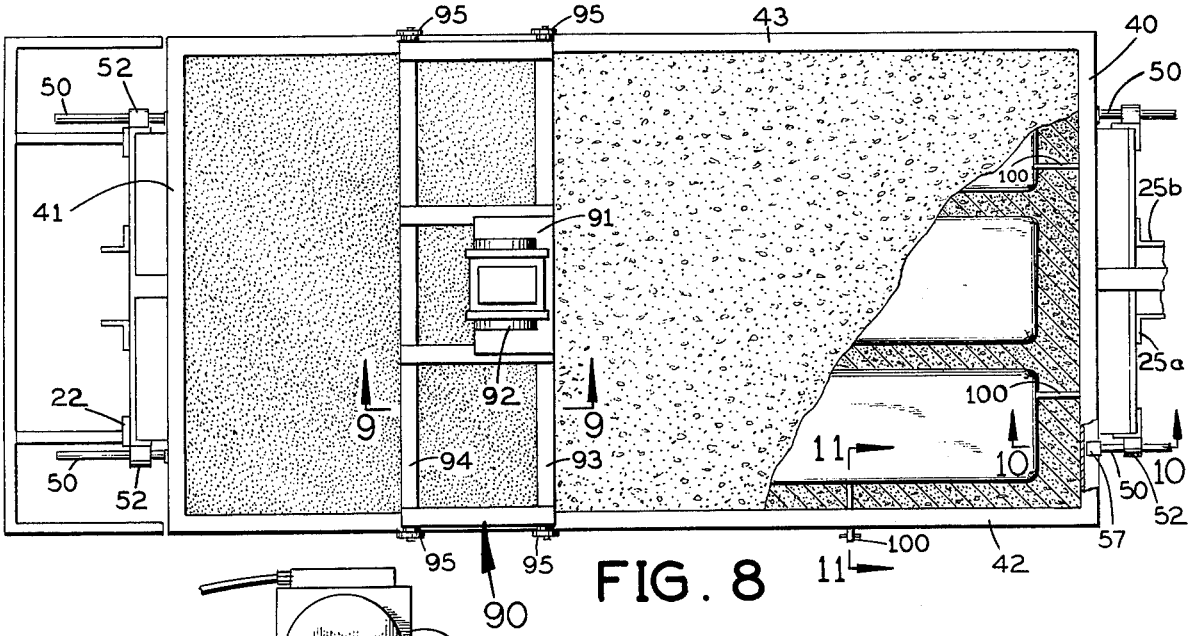
FIG. 8 is a top plan view of the apparatus partly broken away for clarity and showing the screed for leveling the top surface of the wet concrete in the upright mold.

An open-topped, rectangular mold frame is located at the top of the support framework and is connected at its opposite ends to the pivot shafts 34 and 36, respectively. As best seen in FIG. 8, this mold frame has transverse end pieces 40 and 41 and similar longitudinal front and back pieces 42 and 43, which are rigidly interconnected to define the periphery of a rectangular, horizontally disposed mold cavity. These end pieces and front and back pieces of the mold frame preferably are channel beams, with the flanges facing outward. The mold frame also has five bottom cross pieces 44 (FIG. 1) which extend from front-to-back between the longitudinal pieces 42 and 43 of the frame and are spaced below the bottom of these longitudinal pieces and the end pieces 40 and 31 by spacers 45. These bottom cross pieces also are channel beams. The spacers 45 are welded or otherwise rigidly connected to the bottom cross pieces 44 and to the longitudinal pieces 42, 43 or the end pieces 40, 41, so that the entire mold frame is a rigid unit.

Figure 7:
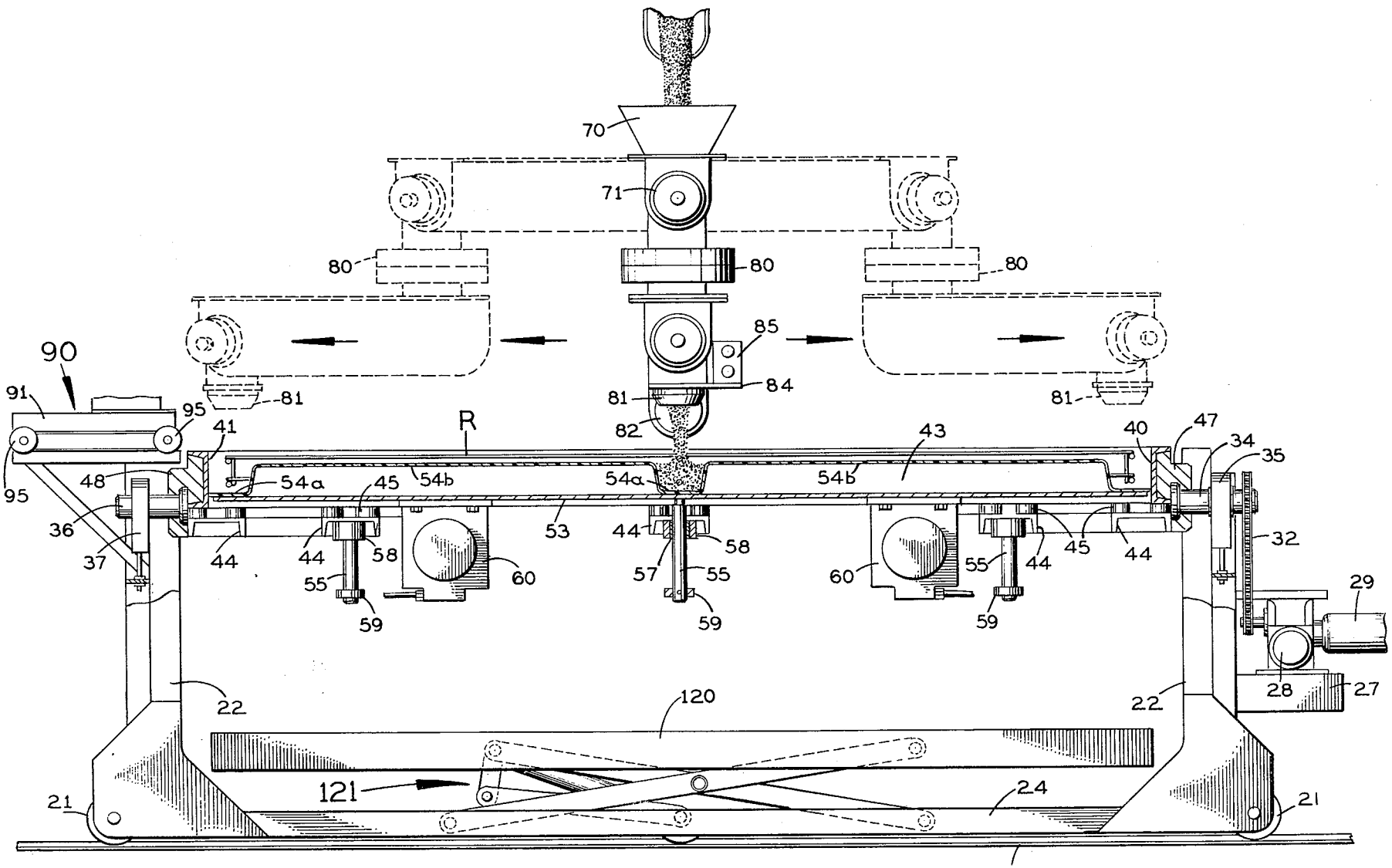
FIG. 7 is a view of the present apparatus partly in front elevation, partly in longitudinal section, and partly in phantom, with the mold held upright and being filled with wet concrete by the pouring mechanism of FIGS. 2 and 3.

As shown in FIG. 7, the right end piece 40 of the mold frame carries a block 47 at a location midway across its length from front-to-back on the apparatus. This block is rigidly attached to the inner (left) end of the motor-driven pivot shaft 34 in any suitable fashion such that rotation of this shaft is imparted to the entire mold frame.

At the opposite end, the left end piece 41 of the mold frame carries a similar block 48, located midway across its length from front-to-back, and this block is similarly rigidly coupled to the inner (right) end of the other pivot shaft 36.

Normally, the mold frame is held horizontal and is prevented from rotation by pairs of locking pins 50 located near the corners of its opposite ends, as best seen in FIG. 8. The pins of each end pair are located on opposite sides of the respective pivot shaft 34 or 36, toward the front and back, respectively.

FIG. 10 shows one of these locking pins in detail. At its inner end the pin carries a generally rectangular block 51, which has a snug fit in the outwardly-facing channel in the adjacent end piece 40 of the mold frame 40–45. As long as each locking pin and block 50, 51 are in the locking position shown in full lines in FIG. 10, the mold frame is held stable in a horizontal, upright position and cannot be turned. However, when each locking pin and block 50, 51 is retracted to the phantom line position in FIG. 10, the mold frame may be turned about the conjoint axis of the pivot shafts 34 and 36. Each locking pin 50 is slidably supported by a bracket 52, which is bolted to the upper end of the corresponding corner post 22 of the support framework of the apparatus.

It is to be understood that each of the other locking pins is mounted in the same fashion and cooperates in the same way with the adjacent end piece 40 or 41 of the mold frame.

With this arrangement, when all four locking pins are pushed in, the mold frame is rigidly supported and stabilized near each of its four corners, and the mold frame can be rotated only after all four of these locking pins are pulled out to disengage their respective blocks 51 from the channels in the adjacent end pieces 40, 41 of the rocker frame.

The mold assembly in this apparatus includes (FIG. 7) a flat bottom plate 53 and a core 54, which are separate from the rigid, unitary mold frame 40–45. The bottom plate 53 is a permanent part of the apparatus but it is displaceable vertically inside the mold frame 40–45. The core 54 is replaceable, depending upon the design of the particular concrete panel that is to be molded in the apparatus. That is, the particular core 54 shown in the drawings may be replaced by a different core, which may have the same rectangular peripheral outline and size, or may be smaller. In the case of a smaller-sized core, the space inside the rectangular mold frame 40–45 not taken up by the core is filled with a suitable filler.

Figure 12:
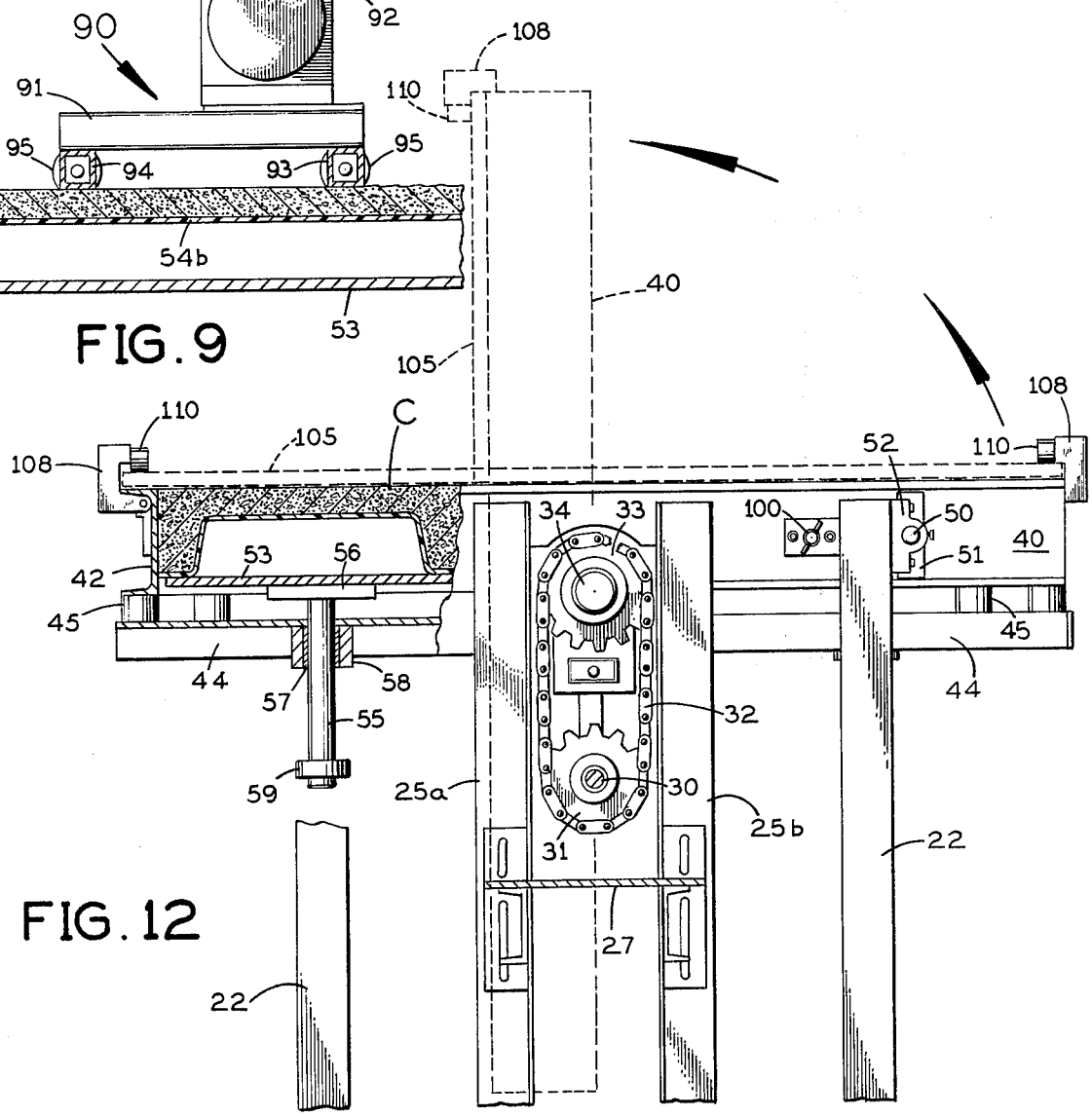
FIG. 12 is an end elevation of the present apparatus, broken away in part for clarity, showing the mold in its upright position in full lines and pivoted half-way toward its inverted position in phantom lines.

Attached to the underside of the bottom plate 53 are a plurality of vertical guide pins 55, each having a flat plate 56 at its upper end which is welded or otherwise permanently connected to the bottom plate 53. Each guide pin 55 extends down through a respective anti-friction sleeve bearing 57 carried by a sleeve 58 that is welded to the underside of a corresponding bottom cross piece 44 of the mold frame, as shown in FIGS. 7 and 12. At its lower end each guide pin 55 carries an annular collar 59.

In the normal, upright position of the mold assembly, the bottom plate 53 rests on certain of the spacers 45 carried by the bottom cross pieces 44 of the mold frame.

In accordance with an important aspect of this invention, two vibrators 60 of known design are attached directly to the underside of the bottom plate 53 in the mold assembly. When energized, these vibrators vibrate the bottom plate up and down for the purpose of settling the wet concrete poured into the mold, as explained hereinafter. It has been found that this achieves a better homogeneity of the finished concrete panel than previous arrangements for vibrating the mold frame, rather than a separate bottom plate in the mold frame.

The core 54 of the mold assembly rests on top of the bottom plate 53 inside the rectangular outline of the mold frame 40–43, as shown in FIG. 7.

FIG. 4 shows the core in perspective. It has a flat, planar wall 54*a*, which rests directly on top of the bottom plate 53 when the mold assembly is upright (FIG. 7) and a plurality of generally rectangular segments 54*b* which are offset upward from wall 54*a* and therefore are spaced above the bottom wall 53.

This core 54 is releasably attached to the bottom plate 53 by a plurality of latch devices as shown in FIGS. 5 and 6.

Each of these latch devices comprises a bolt or pin 61 and a bifurcated locking member 62. The bolt has an enlarged head 63 on its upper end which overlies an upwardly-offset segment 54*b* of the core, as shown in FIG. 5. The bolt extends down snugly through an opening 64 in this upwardly-offset segment of the core and down through a similar aligned opening 65 in the bottom plate 53. At this location the bolt is formed with an annular peripheral groove 66, which extends down beyond the lower face of the bottom plate 53. The bifurcated locking member 62 snugly straddles the bolt at this groove. This bifurcated member has an enlarged, rounded head 67 at the opposite end from the open end of its slot 68.

With this arrangement, the core 54 of the mold may be assembled to the bottom plate 53 by inserting the bolts 61 in the openings as shown in FIG. 6, and applying the bifurcated locking members 62 to the grooved portions of the respective bolts at the underside of the bottom plate. The core and the bottom plate stay assembled to each other at all times during the operation of the molding apparatus. Whenever any particular core 54 is to be replaced, it is detached from the bottom plate 53 by removing the bifurcated locking members 62 and the corresponding bolts 61.

In accordance with an important aspect of the present invention, the upright mold is filled with wet concrete by a novel and advantageous articulated pouring mechanism shown in FIGS. 1, 2, 3 and 7.

This mechanism includes a hopper 70 into which wet concrete is poured, as shown in FIG. 2. A first horizontal tube 71 extends on one side of this hopper, and a feed screw 72 inside this tube conveys the wet concrete from right to left in FIG. 2. Below the hopper 70, the unitary assembly of the hopper 70 and tube 71 is attached to a downwardly extending, vertical shaft 73 which is rotatably supported by a pair of vertically spaced bearings 74, 75 carried by a floor-mounted stand S. A platform 76 (FIG. 1) is attached to the unitary assembly of hopper 70 and tube 71 at one side of the hopper, and an electric motor 77 is mounted on this platform. This motor drives the feed screw 72 through a flexible endless belt drive arrangement 78.

At the opposite, outer end of the first horizontal tube 71 (away from the hopper 70), the interior of this tube is connected to the interior of a second horizontal tube 79 through a swivel joint coupling 80 of known design, which permits either tube to be pivoted with respect to the other without interfering with the flow of wet concrete from the outer end of the first tube 71 down into this end of the second tube 79.

A feed screw inside this second tube 79 conveys the wet concrete from right to left in FIG. 2, from the outer end of the first tube 71 over to a discharge spout 81 near the opposite end of the second tube. An electric motor 82 mounted below the second tube 79 drives this feed screw through a flexible endless belt 83.

At one side of the discharge spout 81, a bracket 84 carries a switch assembly 85 having a pair of push buttons for controlling the energization of the screw conveyor motors 77 and 82.

With this arrangement, it will be evident that the pouring mechanism is easily adjustable about two different vertical axes, the first at the shaft 73, and the second at the swivel coupling 80 between the first, upper tube 71 and the second, lower tube 79. This makes it easy to move the discharge spout 81 back and forth across the top of the mold assembly so as to overlie directly any desired spot in the mold cavity and not have to rely on settling of the poured concrete within the mold to achieve uniform distribution.

If desired, reinforcing bars R (FIG. 4) may be positioned at appropriate locations in the mold cavity before it is filled with concrete, so that these reinforcing elements become embedded in the concrete filling.

After the wet concrete has been poured into the upright mold, the vibrators 60 are turned on for a suitable interval, such as 15 seconds, to vibrate the bottom plate 53 of the mold assembly up and down to insure that the wet concrete settles and becomes uniformly mixed and distributed throughout the upwardly-facing mold cavity above the core 54.

Figure 9:
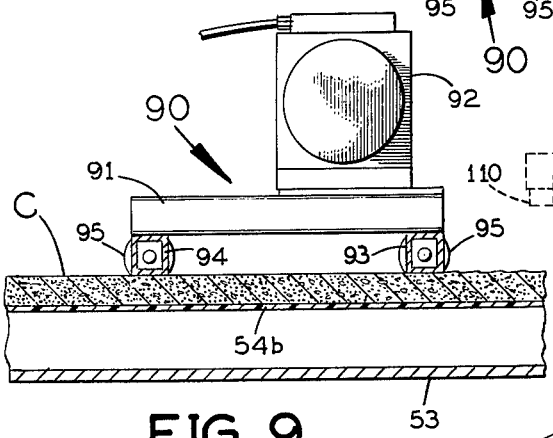
FIG. 9 is a fragmentary vertical section taken along the line 9—9 in FIG. 8 and showing the screed.

Following this, the top of the poured concrete filling in the mold is acted on by a screed mechanism 90 (FIGS. 1, 8 and 9), which removes any excess concrete and smoothes the top surface of the concrete filling in the mold. This screed mechanism includes a horizontal platform 91 on which a vibrator 92 of known design is mounted. Below the platform 91, which is centrally located between the front and the back of the apparatus, a pair of horizontal, flat-bottomed, cross pieces 93 and 94 (FIG. 9) directly overlie the wet concrete in the mold. Flanged rollers 95 on the outer ends of these cross pieces ride along the top of the front and back members 42 and 43 of the mold frame.

With the vibrator 92 turned on, the machine operator can move the screed 90 across the top of the wet concrete in the mold. Except while this screeding operation is being conducted, the screed mechanism normally rests on a horizontal platform 96 (FIG. 1) located at the left end of the apparatus, beyond the left end of the mold frame. This platform is rigidly supported from the corner posts 22 at this end of the support framework of the apparatus.

Preferably, just before the wet concrete is poured into the mold, a plurality of horizontal core pins of the type shown in FIG. 11 are pushed into the mold cavity at locations corresponding to the desired locations for holes in the finished concrete panel.

Referring to FIG. 11, the core pin 100 extends slidably through a flange bushing 101 mounted on the outside of the front piece 42 of the mold frame at a horizontal opening 102 in the latter. The pin is pushed in until it engages an adjacent wall 54*c* of the mold core which extends from the latter's bottom wall 54*a* up to the adjoining upwardly-offset segment 54*b*.

After the concrete has been poured into the mold and has hardened sufficiently adjacent the core pin 100, this pin may be retracted to the phantom line position in FIG. 11, leaving a corresponding horizontal hole or passage in the concrete panel. Normally, this is not done until the mold has been turned upside down and the concrete is ready to be stripped from the mold.

In one practical embodiment, there are two core pins 100 at each longitudinal edge and two core pins at each end edge of the mold, with the pins at opposite edges aligned with each other so that the openings formed in a panel at one edge will be aligned with the openings in a similar panel to which it may be attached.

After the concrete has been poured into the upright mold and screeded, as described, a wooden pallet is placed over the top of the mold and is clamped to the top of the mold frame. Referring to FIG. 12, this pallet includes a flat wooden panel 105 which rests directly on top of the end pieces 40, 41 and the longitudinal pieces 42, 43 of the mold frame and engages the top surface of the concrete in the mold. This panel has the same peripheral size and shape as the top of the mold frame at the outside.

A plurality of pivoted clamp devices, as shown in FIGS. 13 and 14, are provided for clamping this panel of the pallet on top of the mold frame. Each clamp device includes a pivoted mounting piece 106, which is bolted or otherwise rigidly attached to the corresponding channel-shaped side 40, 41, 42 or 43 of the mold frame on the outside. Near its upper end this mounting piece carries a horizontal pivot pin 107 on which is mounted a generally U-shaped member 108, which at one end is bifurcated to straddle the mounting piece 106 as best seen in FIG. 14. At its opposite end, the pivoted member carries a pin 109 on which a rotatably adjustable, eccentric clamping member 110 is mounted.

Normally, this clamp device is in the retracted, inoperative position shown in full lines in FIG. 13. It may be pivoted up about pin 107 to the phantom line position in FIG. 13, in which its eccentric 110 overlies the pallet panel 105, as shown in FIG. 14. The eccentric 110 may be rotated on pin 109 in any desired manner to exert a suitable clamping force on the pallet panel 105 for holding the pallet securely against the top of the mold frame.

Figure 16:
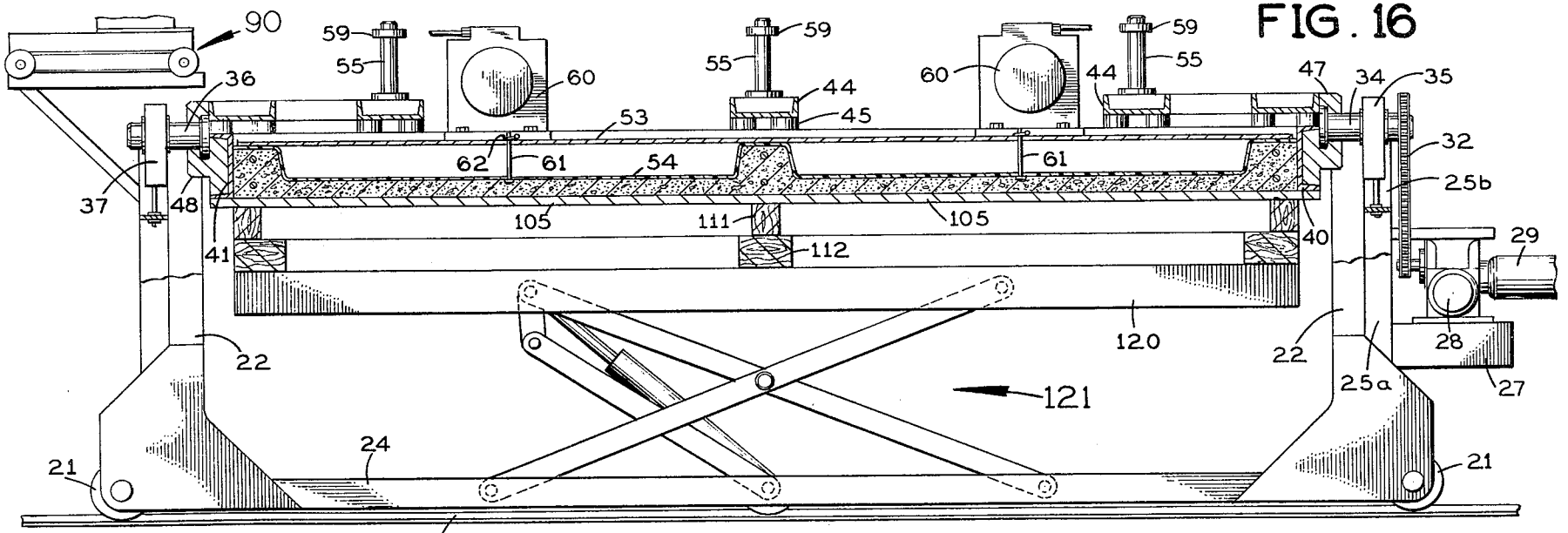
FIG. 16 is a view, partly in front elevation and partly in longitudinal section, showing the mold inverted and the platform below raised to receive the pallet and the concrete panel when the latter is stripped from the mold.
Figure 17:
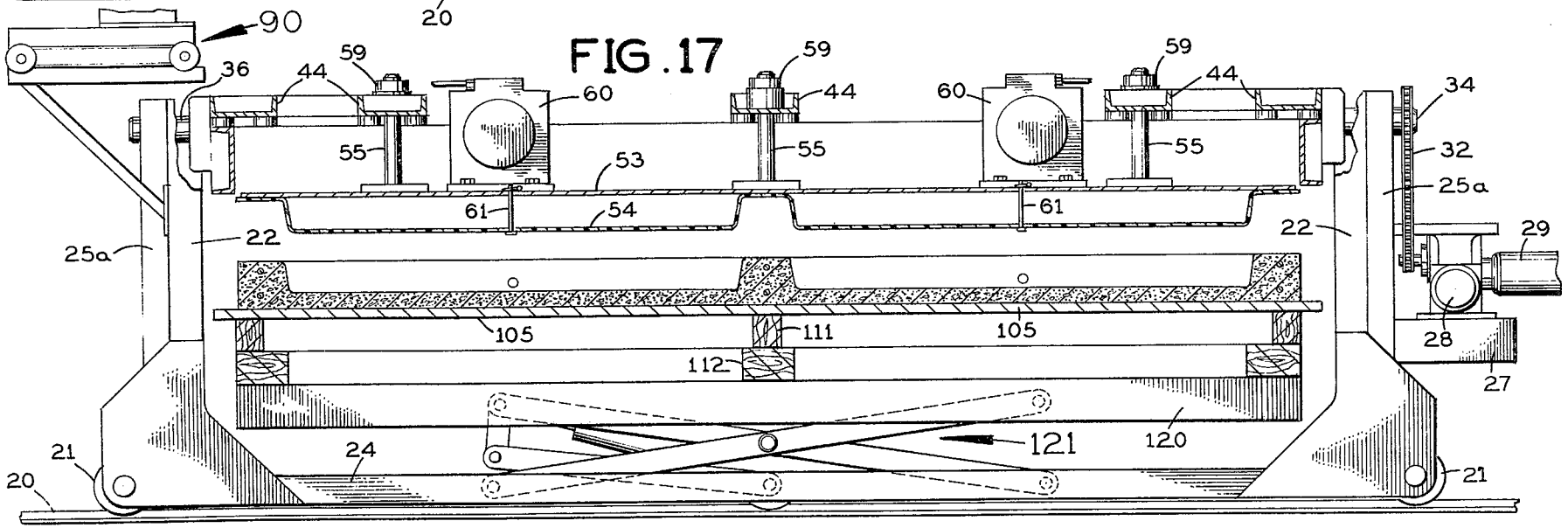
FIG. 17 is a view similar to FIG. 16, with the platform and the pallet lowered and the concrete panel stripped from the mold.

In addition to this flat panel 105, the wooden pallet also has wooden spacer strips which are shown only in the inverted position of the mold and pallet (FIG. 16 and 17). As shown in these Figures, these spacer strips 111 and 112 space the panel 105 of the pallet above a supporting surface, so that the prongs of a fork lift may be inserted beneath the panel 105 between these spacer strips. It will be understood that these spacer strips extend across the top of the pallet panel 105 when the latter overlies the upright mold.

With the pallet clamped in place on top of the mold frame and overlying the wet concrete in the mold, the locking pins 50 at the four corners of the rocker frame and pulled out, freeing this frame to be inverted pivotally. The motor 29 is turned on and it causes the mold frame to be rotated about the conjoint axis of pivot shafts 34 and 36 through 108 degrees from the upright position of FIGS. 7 and 12 to the inverted position of FIGS. 15 and 16. The phantom line showing in FIG. 12 depicts the rocker frame half-way through this pivotal inversion. The clamped-in-place panel 105 of the pallet holds the still wet concrete in the mold and holds the core 54 in place in the mold frame as it is turned over.

After the mold assembly and pallet have been turned over, as described, a horizontal platform 120 is raised to engage and support the pallet from below, as shown in FIG. 16. This platform extends longitudinally between the opposite ends 40, 41 of the mold frame and from front to back between the front and back pieces 42, 43 of the mold frame. It is raised and lowered by a mechanical linkage 121 operated by a hydraulical cylinder and piston unit, the details of which need not be disclosed for an understanding of the present invention.

After the platform 120 has been raised, the clamps shown in FIGS. 13 and 14 are released, so that the pallet is no longer clamped to the inverted mold frame. Also, the core pins 100 are pulled out now so as not to interfere with the stripping of the concrete filling from the inverted mold.

Now the platform 120 is lowered. The pallet 105, 111, 112 moves down with the platform. Initially, the bottom plate 53 and the core 54 of the mold assembly move down within the mold frame as the platform 120 and the pallet move down. This downward movement of the bottom plate and core within the mold frame is limited by the engagement of the collars 59 on the guide pins 55 against the upper ends of the respective bearings 58. During this short downward movement these pins are guided slidably by the bearings 58 so that they move vertically and guide the inverted bottom plate and core assembly vertically as it moves down.

It will be evident from FIG. 16, that when the bottom plate 53 and core 54 of the mold assembly reach their downward limit of movement with respect to the mold frame, the concrete filling will have been completely stripped from the sides of the mold frame. This stripping takes place due to the combined weight of the still-wet concrete itself and the mold core 54, bottom plate 53, and guide pins 55. During this stripping action the pins 55 guide these downwardly moving parts so that they move vertically.

After the bottom plate 53 and the core 54 reach their downward limit, the concrete filling continues to move down with the pallet due to its own weight, and it strips itself from the core 54.

After the platform 120 has been completely lowered, the pallet 105, 111, 112 with the concrete panel resting on it may be removed from the platform by a fork lift.

From the foregoing description, read in conjunction with the accompanying drawings, it will be evident that the present apparatus embodies a novel and convenient arrangement for pouring concrete into the cavity of the upright mold, a novel arrangement for vibrating the mold to settle the concrete filling, and an advantageous for pivotally inverting the filled mold about a vertically-fixed, horizontal axis, after which the concrete filling is stripped from the inverted mold in a novel manner. It will be evident, also, that the present invention embodies a novel method of molding a concrete panel by a novel sequence of steps relating to filling the mold with concrete, inverting the filled mold pivotally about a vertically-fixed, horizontal axis, and withdrawing the concrete filling from the mold.

I claim:

1. In an apparatus for molding a thin concrete panel of broad surface area, said apparatus having a rigid, unitary mold frame which provides the peripheral sides of a mold cavity;

a support framework for the mold frame having upstanding supports outside the mold frame at opposite ends of the latter;

a pair of aligned, horizontal pivot shafts pivotally connecting said opposite ends of the mold frame to said upstanding supports for pivotal adjustment of said mold frame through 180° between an upright horizontal position and an inverted horizontal position;

a separate bottom plate slidably vertically inside said mold frame and located at the bottom of the mold frame when the latter is in its upright position;

a mold core resting on top of said bottom plate inside the mold frame when the mold frame is in said upright position;

clamp means operatively engaging the mold frame to releasably clamp a pallet on top of the mold frame to extend horizontally across the top of the mold cavity therein above said bottom plate and said core in said upright position of the mold frame and to extend horizontally beneath the mold cavity in said inverted position of the mold frame;

and a vertically displaceable horizontal platform beneath the mold frame for engaging the pallet from below in said inverted position of the mold frame and for carrying the pallet down away from the inverted mold frame after said clamp means has released the pallet from the inverted mold frame;

the improvement:

wherein said opposite ends of the mold frame have outwardly-facing recess means therein on opposite sides of said pivot shafts;

and further comprising two pairs of locking members respectively supported by said upstanding supports at said opposite ends of the mold frame, with the locking members of each pair being respectively located on opposite sides of the corresponding pivot shaft and being slidably mounted for horizontal displacement between an outwardly retracted position spaced beyond the adjacent end of the mold frame and an inner position snugly received in the corresponding recess means in the adjacent end of the mold frame to hold the mold frame horizontal in both its upright and inverted positions.

2. An apparatus according to claim 1, wherein each of said opposite ends of the mold frame is a channel member with a recess along its length which is open at the outside of the corresponding end of the mold frame, and each of said locking members is shaped complementary to the recess in the adjacent channel member for snug reception therein when the locking member is in its inner position.

3. An apparatus according to claim 1, wherein said mold frame is rectangular in outline, and said locking members are located respectively near the corners of the mold frame.

* * * * *